US010108120B2

(12) United States Patent
Gotoda

(10) Patent No.: US 10,108,120 B2
(45) Date of Patent: Oct. 23, 2018

(54) SEPARABLE FUSING DEVICE AND PRINTER USING THE SAME

(71) Applicant: AVISION INC., Hsinchu (TW)

(72) Inventor: Katsuhiko Gotoda, Hsinchu (TW)

(73) Assignee: Avision Inc. (TW)

( * ) Notice: Subject to any disclaimer, the term of this patent is extended or adjusted under 35 U.S.C. 154(b) by 5 days.

(21) Appl. No.: 15/411,135

(22) Filed: Jan. 20, 2017

(65) Prior Publication Data

US 2017/0131668 A1 May 11, 2017

Related U.S. Application Data

(63) Continuation of application No. 14/278,267, filed on May 15, 2014, now Pat. No. 9,551,964.

(30) Foreign Application Priority Data

Feb. 18, 2014 (TW) ..... 103202750 U

(51) Int. Cl.
*G03G 15/16* (2006.01)
*G03G 15/20* (2006.01)

(52) U.S. Cl.
CPC ..... *G03G 15/2089* (2013.01); *G03G 15/2035* (2013.01); *G03G 15/2085* (2013.01); *G03G 15/2064* (2013.01)

(58) Field of Classification Search
None
See application file for complete search history.

(56) References Cited

U.S. PATENT DOCUMENTS

| | | | | |
|---|---|---|---|---|
| 4,428,660 | A | 1/1984 | Matsumoto | |
| 4,605,218 | A | 8/1986 | Knepper et al. | |
| 5,448,347 | A | 9/1995 | Mills | |
| 9,551,964 | B2 * | 1/2017 | Gotoda | G03G 15/2035 |
| 2007/0077104 | A1 | 4/2007 | Hasegawa | |
| 2008/0069589 | A1 | 3/2008 | Chang et al. | |
| 2009/0074440 | A1 | 3/2009 | Nanno et al. | |
| 2012/0155931 | A1 | 6/2012 | Ando | |

* cited by examiner

*Primary Examiner* — David M Gray
*Assistant Examiner* — Geoffrey T Evans

(57) ABSTRACT

A fusing device includes a pressure roller, a heating roller, a pressure applying element and a releasing element is provided. The pressure roller is installed in a frame. The heating roller opposite to the pressure roller is installed in a housing. The pressure applying element connects the pressure roller and the housing at a first side and applies a force on the pressure roller and the heating roller. The releasing element releases and locks the pressure roller and the housing at a second side. A printer from which jammed sheet may be easily removed is provided. The printer includes a frame, a housing, an image forming device, and the fusing device. The first and second sides are parallel to axial direction of the pressure roller and the heating roller. The image forming device forms an image on a medium. The fusing device fuses the image on the medium.

14 Claims, 4 Drawing Sheets

SEPARABLE FUSING DEVICE AND PRINTER USING THE SAME

This application is a continuation application of co-pending application Ser. No. 14/278,267, filed May 15, 2014, which claims the benefit of Taiwan application Serial No. 103202750, filed on Feb. 18, 2014, the contents of which are incorporated herein by reference.

BACKGROUND OF THE INVENTION

Field of the Invention

The invention relates in general to a fusing device and printer using the same, and more particularly to a separable fusing device capable of easily separating a heating roller from a pressure roller and a printer using the separable fusing device.

Description of the Related Art

In order to fuse toner on the surface of a sheet, a conventional printer and copy machine normally includes a fusing device, which melts the tone with high temperature and high pressure and further fuses the toner on the surface of the sheet. The fusing device includes a heating roller and a pressure roller, which are modularized and combined together as a fusing module. Then, the fusing module is installed in a frame. However, such design not only increases material cost and assembly procedures but also makes it difficult to separate the heating roller from the pressure roller. Once sheet are jammed between the two rollers and the user is unable to remove the jammed sheet, the user will have to need to call on a professional maintenance technician to resolve the problem. Such situation not only causes inconvenience to the user but also incurs maintenance cost to the supplier.

SUMMARY OF THE INVENTION

An object of the invention is to provide a separable fusing device and a printer from which jammed a sheet may be easily removed. The user may separate a heating roller from a pressure roller to conveniently remove the jammed sheet without calling on any professional maintenance technicians, so that the user may save cost of time and money, and the supplier also may save maintenance cost.

Another object of the invention is to provide a fusing device directly installed in a frame and a printer using the fusing device capable of simplifying assembly procedures, saving material cost and reducing manufacturing cost.

To achieve the said objects of the invention, a separable fusing device is provided. The separable fusing device includes a pressure roller, a heating roller, a pressure applying element and a releasing element. The pressure roller is installed in a frame. The heating roller opposite to the pressure roller is installed in a housing. The pressure applying element is connected to the pressure roller and the housing at a first side, and applies a force on the pressure roller and the heating roller at the first side. The releasing element opposite to the pressure applying element releases or locks the pressure roller and the housing at a second side.

To achieve the said objects of the invention, a printer from which jammed sheet may be easily removed is provided. The printer includes a frame, a housing, an image forming device and a fusing device. The image forming device is installed in the frame. The fusing device includes a pressure roller, a heating roller, a pressure applying element and a releasing element. The pressure roller is installed in the frame. The heating roller opposite to the pressure roller is installed in the housing. The pressure applying element is connected to the pressure roller and the housing at a first side, and applies a force on the pressure roller and the heating roller at the first side. The releasing element opposite to the pressure applying element releases or locks the pressure roller and the housing at a second side. The first side and the second side are substantially parallel to an axial direction of the pressure roller and the heating roller. The image forming device forms an image on a medium. The fusing device fuses the image on the medium.

The above and other aspects of the invention will become better understood with regard to the following detailed description of the preferred but non-limiting embodiment (s). The following description is made with reference to the accompanying drawings.

DETAILED DESCRIPTION OF THE INVENTION

To make the characteristics, contents, advantages, and effects of the invention more apparent and easier to understand, the invention is disclosed with accompanying drawings, and is described by way of embodiments. A number of drawings are used in the embodiments for describing the specification. However, these drawings are schematic only, and do not necessarily reflect the actual scales and disposition relationships of the components of the implementations of the invention. Therefore, the scales and disposition relationships of the accompanying drawings should not be interpreted as actual scales and disposition relationships, and are not restrictive of actual implementations of the invention.

Advantages, characteristics and technical methods of the invention are disclosed with reference to exemplary embodiments and accompanying drawings to make the invention more apparent and easier to understand. Furthermore, the invention may be implemented in different forms, and is not limited to the embodiments disclosed below. Conversely, for anyone who is skilled in the technology field of the invention, the disclosed embodiments thoroughly and completely express the scope of the invention, and the invention will define only the appended claims.

Figure 1:
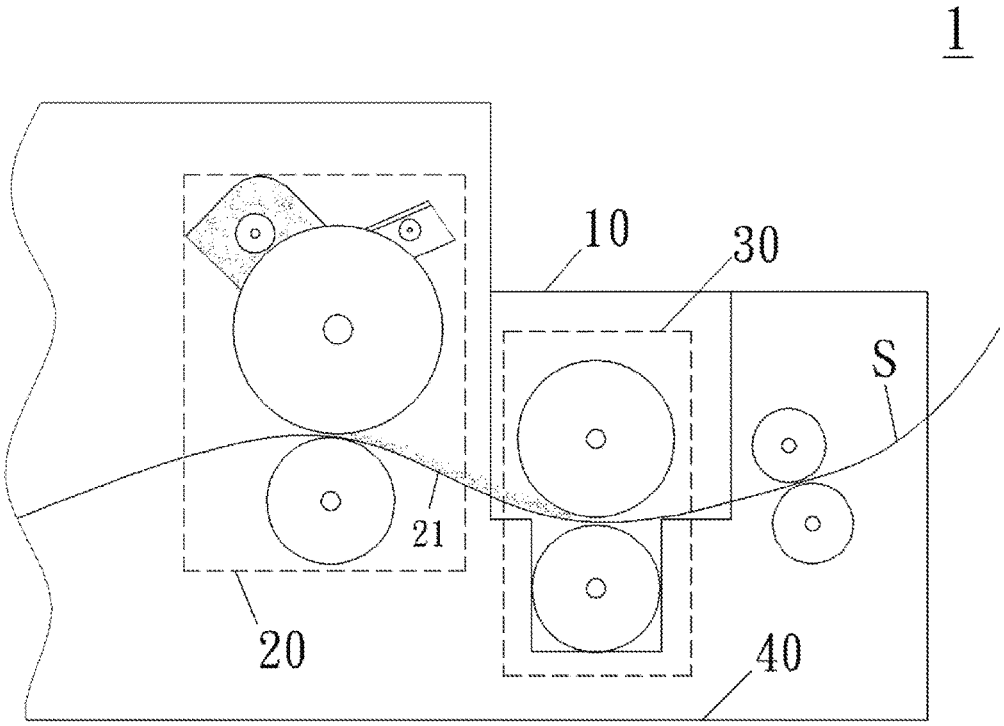
FIG. 1 is a schematic diagram of a printer from which jammed sheet may be easily removed according to a preferred embodiment of the invention.
Figure 2:
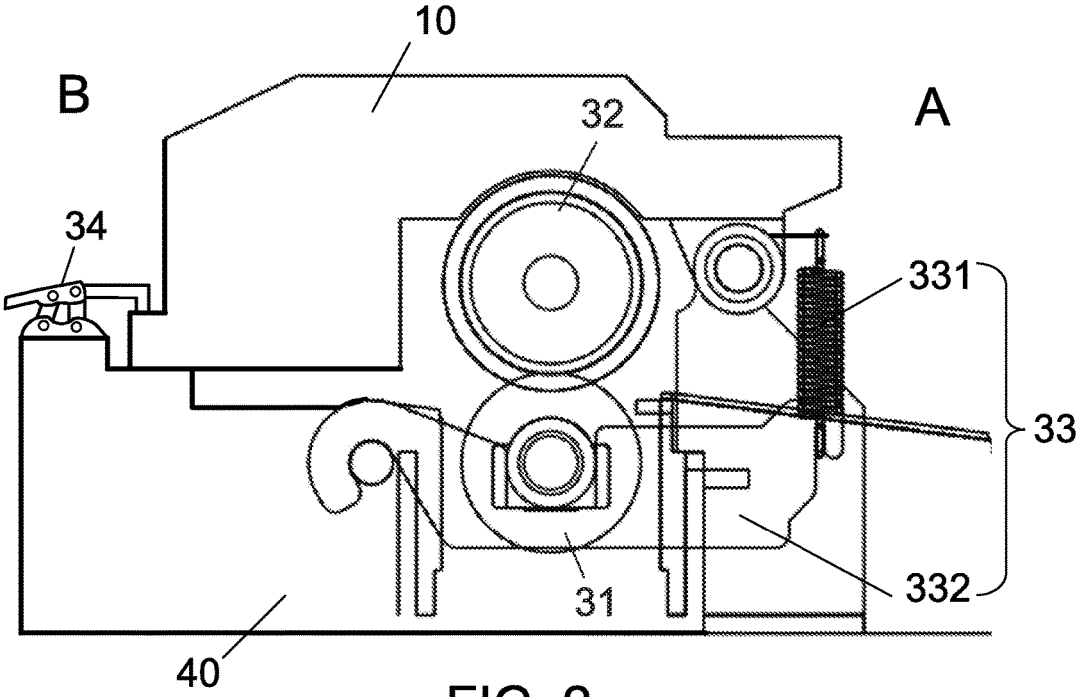
FIG. 2 is a schematic diagram of a fusing device of FIG. 1.
Figure 3:
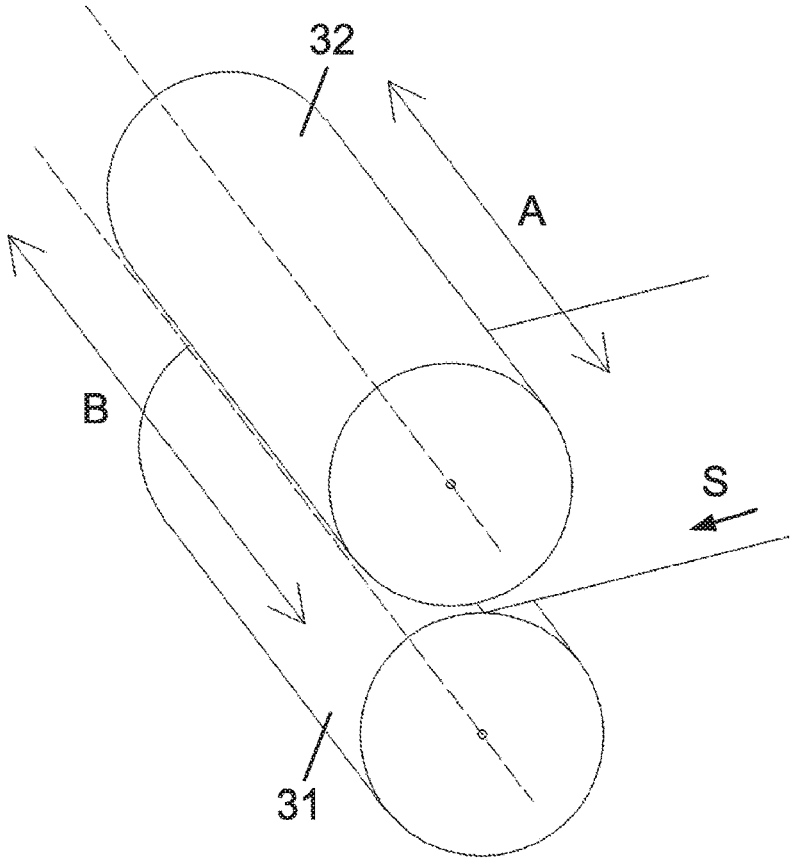
FIG. 3 is a 3D diagram of a fusing device of FIG. 2.

FIG. 1 is a schematic diagram of a printer from which jammed sheet may be easily removed according to a preferred embodiment of the invention. As indicated in FIG. 1, the printer 1 includes a housing 10, an image forming device 20, a fusing device 30 and a frame 40. The image forming device 20 forms an image 21 on a medium S. The fusing device 30 fuses the image 21 on the medium S. In the present embodiment, the image forming device 20 spreads toner on the medium S to form the image 21, and the fusing device 30 melts the toner with high temperature and high pressure and further fuses the toner on a surface of the medium S, but the invention is not limited thereto. FIG. 2 is a schematic diagram of a fusing device of FIG. 1. As indicated in FIG. 2, the fusing device 30 includes a pressure roller 31, a heating roller 32, a pressure applying element 33 and a releasing element 34. The pressure roller 31 is directly installed in the frame 40. The heating roller 32 opposite to the pressure roller 31 is installed in the housing 10. The medium S with toner may pass the space between the heating roller 32 and the pressure roller 31 so that the toner may be melted and fused on the medium S. The pressure applying element 33 is connected to the pressure roller 31 and the housing 10 at a first side A, and applies a force F on the pressure roller 31 and the heating roller 32 at the first side A. The pressure applying element 33 further includes an elastic member 331 and a latch 332. The elastic member 331 connects the housing 10 and the latch 332. The releasing element 34 opposite to the pressure applying element 33 releases or locks the pressure roller 31 and the housing 10 at a second side B. FIG. 3 is a 3D diagram of a fusing device of FIG. 2. As indicated in FIG. 3, the first side A and the second side B are substantially parallel to an axial direction of the pressure roller 31 and an axial direction of the heating roller 32. In the present embodiment, the first side A is an upper-stream side of the fusing device 30 (sheet feeding side), and the second side B is down-stream side of the fusing device 30 (sheet exit side).

Figure 4:
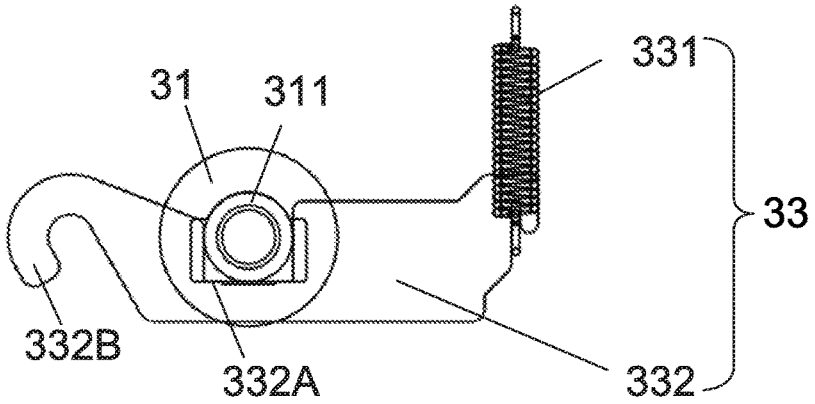
FIG. 4 is a schematic diagram of a pressure applying element of FIG. 2.

FIG. 4 is a schematic diagram of a pressure applying element of FIG. 2. The pressure roller 31 further includes a bearing 311 mounted at an end portion of a shaft of the pressure roller 31. The latch 332 has a recess 332A for carrying the bearing 311. The latch 332 further includes a connection portion 332B for moveably connecting the latch 332 to the frame 40. The elastic member 331 includes a compression spring.

Figure 5:
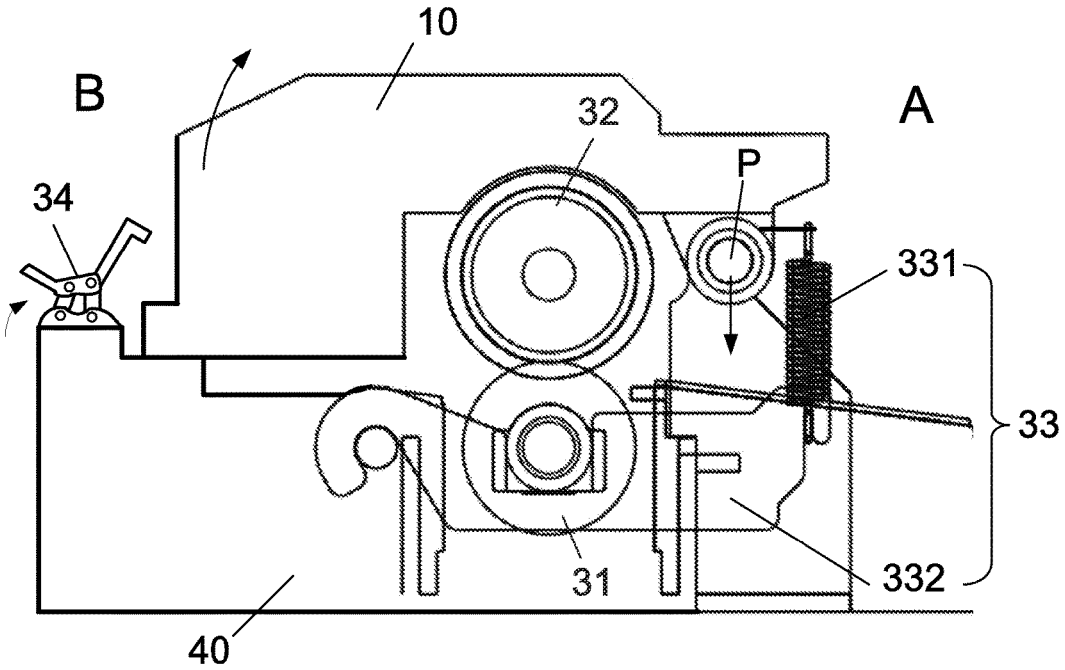
FIG. 5 is another schematic diagram of a fusing device of FIG. 1.

FIG. 5 is another schematic diagram of a fusing device of FIG. 1. FIG. 5 is different from FIG. 2 in that the releasing element 34 of FIG. 5 releases the pressure roller 31 and the housing 10 while the releasing element 34 of FIG. 2 locks the pressure roller 31 and the housing 10. As indicated in FIG. 2, when the releasing element 34 locks the frame 40 and the housing 10 at the second side B, the pressure roller 31 tightly contacts the heating roller 32. When the user wants to separate the pressure roller 31 from the heating roller 32, the user may activate the releasing element 34 as indicated in FIG. 5. When the releasing element 34 releases the frame 40/the pressure roller 31 and the housing 10 at the second side B, the pressure applying element 33 still apples a force at the first side A, and the housing 10 at the second side is lifted upwards (rotated clock-wise) around a pivotal point P. In addition, the heating roller 32 is installed in the housing 10, so that the pressure roller 31 may be accordingly separated from the heating roller 32. In the present embodiment, the releasing element 34 includes a four bar linkage mechanism, and the user may press or lift a button of the four bar linkage mechanism to release or lock the second side B, but the invention is not limited thereto. The releasing element 34 may include a hook, a draw bar, a mechanical element or an element of any type capable of selectively releasing or locking the pressure roller 31 and the housing 10. For example, the releasing element 34 may release or lock the pressure roller 31 and the housing 10 by using a solenoid valve.

Figure 6A:
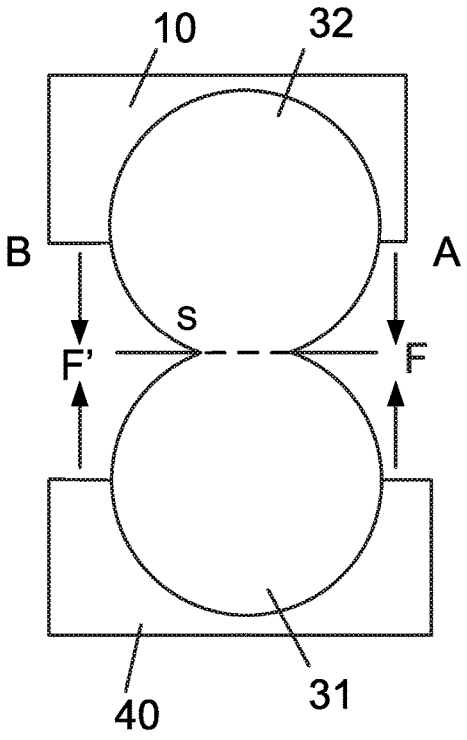
FIG. 6A and FIG. 6B are schematic diagrams of a pressure roller and a heating roller receiving a force according to a preferred embodiment of the invention.
Figure 6B:
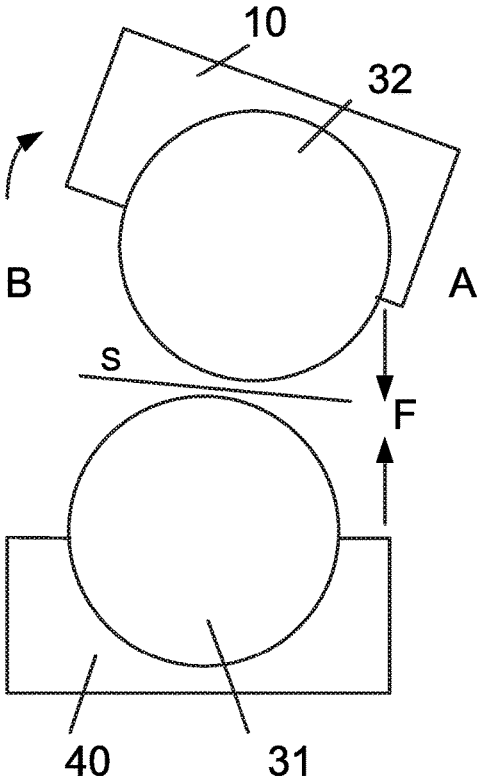

The function of the releasing element 34 is disclosed below. FIG. 6A and FIG. 6B are schematic diagrams of a pressure roller and a heating roller receiving a force according to a preferred embodiment of the invention. As indicated in FIG. 6A, the pressure applying element 33 provides a force F to a first side A. When the releasing element 34 locks the housing 10 and the pressure roller 31, it provides a force F' to a second side B to maintain a balance between the two forces. Under such circumstance, the forces applied on the pressure roller 31 and the heating roller 32 make the pressure roller 31 and the heating roller 32 tightly contact each other. Since outer layers of the pressure roller 31 and the heating roller 32 have a certain degree of flexibility, the pressure roller 31 and the heating roller 32 having been pressed will be slightly deformed and the contact area between the medium S and the pressure roller 31 and the contact area between the medium S and the heating roller 32 will both be increased. Accordingly, the medium S will be heated and compressed for a longer duration, so that the image formed with the toner may be more effectively fused on the medium S. As indicated in FIG. 6B, when the releasing element 34 is released, the releasing element 34 no more provides the force F' at the second side B, Therefore, the housing 10 is lifted upwards in a clock-wise direction to bring the heating roller 32 away from the pressure roller 31. Meanwhile, a gap is formed between the pressure roller 31 and the heating roller 32, so that the user may easily remove the medium S.

The fusing device and the printer of the invention are different from that of the prior art in that the pressure roller is directly installed in the frame, hence reducing assembly procedures, reducing manufacturing cost and simplifying manufacturing process. In addition, the pressure roller and the heating roller are not combined as a module which is not integrate into one piece, and accordingly may be conveniently detached for maintenance.

The invention has another feature. That is, by using a simple button, the user may activate a releasing element to separate the pressure roller from the heating roller, and may easily remove the jammed sheet whenever sheet jam occurs. Therefore, the user does not need to spend time waiting for a professional technician to resolve the problem, and the supplier may save maintenance cost. The invention is beneficial to both the user and the supplier.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A separable fusing device, comprising:

a pressure roller installed in a frame;

a heating roller installed in a housing and opposite to the pressure roller;

a pressure applying element connecting the pressure roller and the housing at a first side, wherein the pressure applying element applies a force on the pressure roller and the heating roller at the first side; and a releasing element installed opposite to the pressure applying element for releasing or locking the pressure roller and the housing at a second side;

wherein the housing is movable with respect to the frame; and wherein the pressure applying element further comprises an elastic member and a latch, and the elastic member connects the rod and the housing.

2. The separable fusing device according to claim 1, wherein the first side and the second side are substantially parallel to an axial direction of the pressure roller and an axial direction of the heating roller.

3. The separable fusing device according to claim 1, wherein the first side is an upper-stream side of the separable fusing device and the second side is a down-stream side of the separable fusing device.

4. The separable fusing device according to claim 1, wherein when the releasing element locks the pressure roller and the housing at the second side, the pressure roller tightly contacts the heating roller, and when the releasing element releases the pressure roller and the housing on the second side, the housing is lifted upwards and the pressure roller is separated from the heating roller.

5. The separable fusing device according to claim 1, wherein the pressure roller further comprises a bearing mounted at an end portion of a shaft of the pressure roller, and the latch has a recess for carrying the bearing.

6. The separable fusing device according to claim 1, wherein the latch is moveably connected to the frame.

7. The separable fusing device according to claim 1, wherein the releasing element is a hook.

8. The separable fusing device according to claim 1, wherein the releasing element is a four bar linkage mechanism.

9. A printer from which jammed a sheet may be removed, comprising:

a frame;

a housing;

an image forming device installed in the frame; and a separable fusing device, comprising:

a pressure roller installed in the frame;

a heating roller installed in the housing and opposite to the pressure roller;

a pressure applying element connected to the pressure roller and the housing at a first side, wherein the pressure applying element applies a force on the pressure roller and the heating roller at the first side; and a releasing element opposite to the pressure applying element for releasing or locking the pressure roller and the housing at a second side;

wherein the first side and the second side are substantially parallel to an axial direction of the pressure roller and an axial direction of the heating roller;

wherein the image forming device forms an image on a medium, and the separable fusing device fuses the image on the medium;

wherein the housing is movable with respect to the frame; and wherein the pressure applying element further comprises an elastic member and a latch, and the elastic member connects the rod and the housing.

10. A separable fusing device, comprising:

a pressure roller installed in a frame;

a heating roller installed in a housing and opposite to the pressure roller;

a pressure applying element connecting the pressure roller and the housing at a first side, wherein the pressure applying element applies a force on the pressure roller and the heating roller at the first side; and a releasing element installed opposite to the pressure applying element for releasing or locking the pressure roller and the housing at a second side;

wherein the frame and the housing are pivotally connected at a pivotal axis, and the heating roller is rotatable with the housing around the pivotal axis.

11. The separable fusing device according to claim 10, wherein the first side and the second side are substantially parallel to an axial direction of the pressure roller and an axial direction of the heating roller.

12. The separable fusing device according to claim 10, wherein the first side is an upper-stream side of the separable fusing device and the second side is a down-stream side of the separable fusing device.

13. The separable fusing device according to claim 10, wherein when the releasing element locks the pressure roller and the housing at the second side, the pressure roller tightly contacts the heating roller, and when the releasing element releases the pressure roller and the housing on the second side, the housing is lifted upwards and the pressure roller is separated from the heating roller.

14. The separable fusing device according to claim 10, wherein the pressure applying element further comprises an elastic member and a latch, and the elastic member connects the latch and the housing; wherein the pressure roller further comprises a bearing mounted at an end portion of a shaft of the pressure roller, and the latch has a recess for carrying the bearing.

* * * * *